US007334887B2

(12) United States Patent
Andersen et al.

(10) Patent No.: US 7,334,887 B2
(45) Date of Patent: Feb. 26, 2008

(54) INK CONTAINER FOR AN INK JET CARTRIDGE

(75) Inventors: Stephen A. Andersen, Williamson, TN (US); Dennis M. Lengyel, Ontario, NY (US)

(73) Assignee: Nu-kote International, Inc., Franklin, TN (US)

( * ) Notice: Subject to any disclaimer, the term of this patent is extended or adjusted under 35 U.S.C. 154(b) by 78 days.

(21) Appl. No.: 10/754,991

(22) Filed: Jan. 12, 2004

(65) Prior Publication Data

US 2005/0151808 A1 Jul. 14, 2005

(51) Int. Cl.
*B41J 2/175* (2006.01)

(52) U.S. Cl. ..... 347/86; 347/85

(58) Field of Classification Search ..... 347/86, 347/85

See application file for complete search history.

(56) References Cited

U.S. PATENT DOCUMENTS 6,312,115 B1 * 11/2001 Hara et al. ..... 347/86
6,332,673 B1 * 12/2001 Higuma et al. ..... 347/86
6,422,692 B2 * 7/2002 Yamazaki et al. ..... 347/86
6,474,801 B2 * 11/2002 Higuma et al. ..... 347/86
2002/0027582 A1 * 3/2002 Shimomura et al. ..... 347/86
2002/0191058 A1 * 12/2002 Anderson et al. ..... 347/86
2002/0191059 A1 * 12/2002 Jones et al. ..... 347/86
2004/0061750 A1 * 4/2004 Cho et al. ..... 347/86
2004/0257412 A1 * 12/2004 Anderson et al. ..... 347/85

FOREIGN PATENT DOCUMENTS

EP 645244 A1 * 3/1995

* cited by examiner

*Primary Examiner*—Stephen Meier
*Assistant Examiner*—Rene Garcia, Jr.
(74) *Attorney, Agent, or Firm*—Faye Sharpe LLP

(57) ABSTRACT

An ink container shell for an ink jet cartridge has spaced apart side walls, a front wall, a rear wall, and a bottom wall, a partition in said shell dividing the interior thereof into first and second chambers for respectively receiving an ink and an ink absorbing material, an opening through the partition for communicating ink in said first chamber with ink absorbing material in the second chamber, and which has a height greater than its width. The shell further includes an outlet port in the bottom wall of the second chamber provided with a wick retaining arrangement, and a block of ink absorbing material in the second chamber having an angled surface facing the opening through the partition and having an area greater than the area of the opening. A lever and tongue component for releasably interengaging the container with a holder therethrough has smooth surfaces and edges to facilitate handling of the container.

12 Claims, 4 Drawing Sheets

INK CONTAINER FOR AN INK JET CARTRIDGE

This invention relates to the art of ink jet printers and, more particularly, to improvements in ink containers and ink container shells for ink jet cartridges.

BACKGROUND OF THE INVENTION

One well-known form of an ink container for ink jet printing comprises a container shell having spaced apart side walls, a front wall, a rear wall, and a bottom wall, a partition in the shell dividing the interior thereof into first and second chambers for respectively receiving an ink and an ink absorbing material, an opening through the partition for communicating ink in the first chamber with ink absorbing material in the second chamber, an outlet port in the bottom wall for the second chamber, a cover closing the upper end of the shell, and a lever attached to the front wall of the shell and which functions to releasably interengage the ink container with a container holder.

In such ink containers and container shells heretofore available, the block of ink absorbing material in the first chamber has a planar bottom and a planar upwardly extending surface at right angles to one another and, when the block of material is in the second chamber, the two surfaces facially engage the bottom wall and partition, respectively. Accordingly, the area of the surface of the block of absorbing material exposed to the opening through the partition between the first and second chambers has an area corresponding to that of the opening. This area relationship limits the transfer rate of ink from the first chamber to the ink absorbing material in the second chamber and also limits the degree or rate of absorption of ink into the ink absorbing material. Further, the window or opening through the partition heretofore has limited the transfer of ink to the lower most portion of the ink absorbing material in the second chamber, thus limiting the saturation level maintained in the ink absorbing material and, again, limiting the rate of transfer from the first chamber to the ink absorbing material.

Further in connection with ink containers and shells heretofore available, the outlet port in the bottom wall of the second chamber receives a wicking material which is interposed between the outlet port and the ink absorbing material and through which ink is supplied to a recording head. Heretofore, the wicking material has been installed into the outlet port through the top of the ink container shell and, during installation and use, the wicking material is free to move inwardly of the second chamber against the block of ink absorbing material therein. The installation arrangement through the interior of the shell is cumbersome and at least somewhat difficult, and the unrestricted movement of the wicking material reduces the capillarity of the ink absorbing material in the region of the wick. Still further, the lever and tongue arrangement by which the ink container is mountable in and removable from a container holder has sharp edges and irregular surfaces which can be uncomfortable to a user in connection with manipulating the lever during insertion and/or removal of the container from the holder.

SUMMARY OF THE INVENTION

Ink container components are provided in accordance with the present invention which advantageously minimize and/or overcome the foregoing and other disadvantages encountered in connection with ink containers heretofore available. In this respect, and in accordance with one aspect of the invention, the block of ink absorbing material in the second ink chamber is provided with a profile which provides a surface facing the opening in the partition between the first and second chambers which has an area greater than the area of the opening. By providing for the ink absorbing material to have such a surface area facing the opening, more surface area of the material is exposed to the liquid ink allowing for a higher level of saturation into the absorbing material and a more constant transfer rate of ink in the first chamber into the ink absorbing material. Furthermore, the enlarged surface area of the ink absorbing material is at the lower end thereof in the container shell whereby, during an inking process when ink is flowing from the first chamber into the second chamber, the enlarged surface area allows the ink to saturate across the lower end portion of the block of material more freely than if the surface area exposed to the flow of ink from the first chamber is provided by a surface facially engaging the partition and thus having an area corresponding to that of the opening. Preferably, the profiled surface is an angled cut between adjacent surfaces of the ink absorbing block which, otherwise, would intersect at a right angle corner at the lower front end of the block of material.

In accordance with another aspect of the invention, the opening in the partition between the first and second chambers has a geometry which provides the opening with a height above the bottom wall of the container shell which is at least equal to and preferably always greater than the width of the opening. This geometry allows the transfer of liquid to the ink absorbing material at a higher point within the block of material, thus optimizing saturation of the lower portion of the block and allowing the ink absorbing material to maintain a consistently higher saturation level while in the printing mode. The latter enables the ink absorbing material to deliver ink at a higher rate and to maintain a consistent back pressure.

In accordance with a further aspect of the invention, the outlet port in the bottom wall of the second chamber is provided with a wick retaining arrangement which enables the wick element to be introduced into the outlet port from the bottom of the ink container shell rather than through the top of the shell as heretofore required. The retaining arrangement limits displacement of the wick element inwardly of the second chamber by providing a surface against which the element abuts to stop any additional movement of the wick into the absorbent material in the chamber. The retaining feature allows for increased compression of the absorbent material at the wick interface, and the increased compression provides for the absorbent material to have a higher capillarity in the region of the interface which provides improved efficiency and better ink flow from the container.

In accordance with yet another aspect of the invention, the latching lever by which the ink container is removably held in a container tank or holder through interengaging detents on the lever and holder is provided with a structure which promotes ease of installation and removal of the container from the holder. In this respect, the tongue or tab at the upper end of the lever is provided with a smooth surface profile including linear edges and rounded corners and planar sides parallel to the front wall of the container shell and one of which sides terminates in a gently curved portion, all of which avoids rough surfaces and sharp edges encountered in connection with ink containers heretofore available. Another feature of the lever and tongue provides for the latter to be connected to the upper end of the lever by a pair of laterally spaced apart fingers which promotes a cost reduction in connection with the production of the container shell.

It is accordingly an outstanding object of the present invention to provide improvements in connection with the component parts of ink containers for an ink jet cartridge.

Another object is the provision of improvements of the foregoing character which promote a higher level of ink saturation and a more constant rate of transfer of ink into the ink absorbing material in the container.

A further object is the provision of improvements of the foregoing character by which ink can saturate across the lower portion of the ink absorbing material more freely than heretofore possible.

Yet a further object is the provision of improvements of the foregoing character by which the transfer of ink to the ink absorbing material is enabled at a higher point within the material than heretofore provided for.

Another object is the provision of improvements of the foregoing character which provide for maintaining a consistently higher saturation level in the ink absorbing material during printing, thus enabling the ink absorbing material to deliver ink at a higher rate and at a consistent back pressure.

Yet another object is the provision of improvements of the foregoing character by which a wick element in the outlet port can be mounted therein easier than heretofore possible and which, when mounted in the port, is limited with respect to displacement inwardly of the container, thus allowing for increased compression of the absorbent material at the wick interface and a higher capillarity of the absorbent material in the region of the interface to promote better efficiency and ink flow.

Yet a further object is the provision of improvements of the foregoing character which promote ease of installation and removal of an ink container relative to a corresponding tank or container holder.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
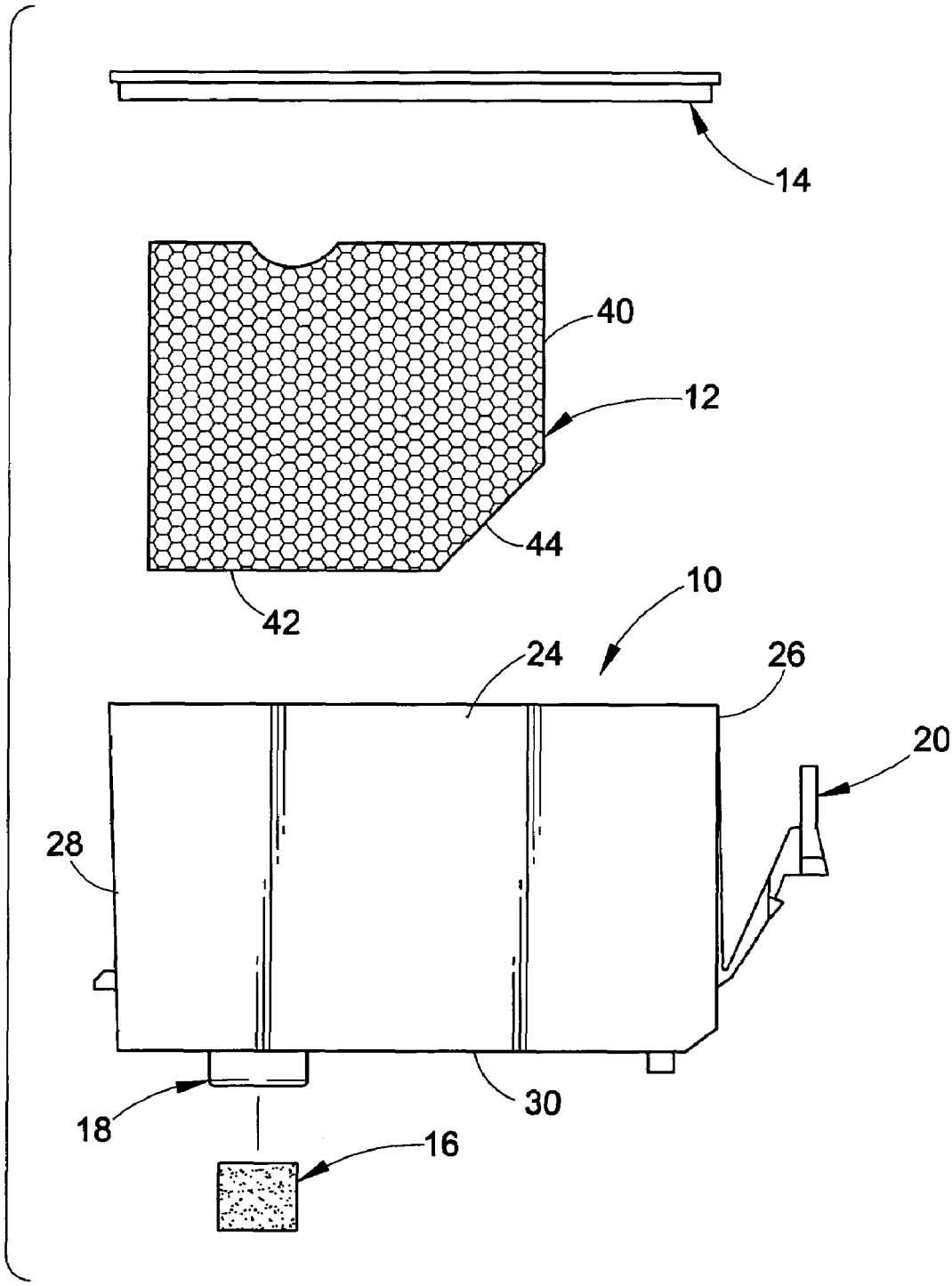
FIG. 1 is an exploded view of the component parts of an ink container in accordance with the invention.

Referring now in greater detail to the drawings, wherein the showings are for the purpose of illustrating preferred embodiments of the invention only and not for the purpose of limiting the invention, FIG. 1 illustrates the component parts of an ink container for an inkjet cartridge, namely a container shell 10, a block of ink absorbing material 12 such as a urethane foam received in a chamber in the container shell, as will become apparent hereinafter, a cover 14 and a wick element 16 of felt or foam which, as described in greater detail hereinafter, is received in outlet port 18 of the container. Shell 10 includes a lever and tongue component 20 by which the container is adapted to be removably mounted in a container holder.

Figure 3:
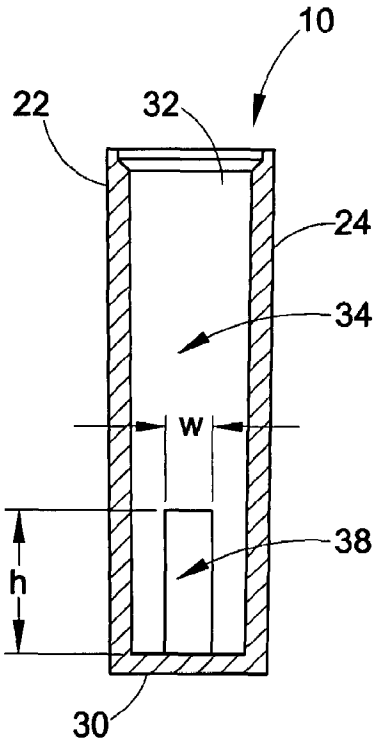
FIG. 3 is a cross-sectional elevation view of the shell looking in the direction of line 3-3 in FIG. 2.
Figure 2:
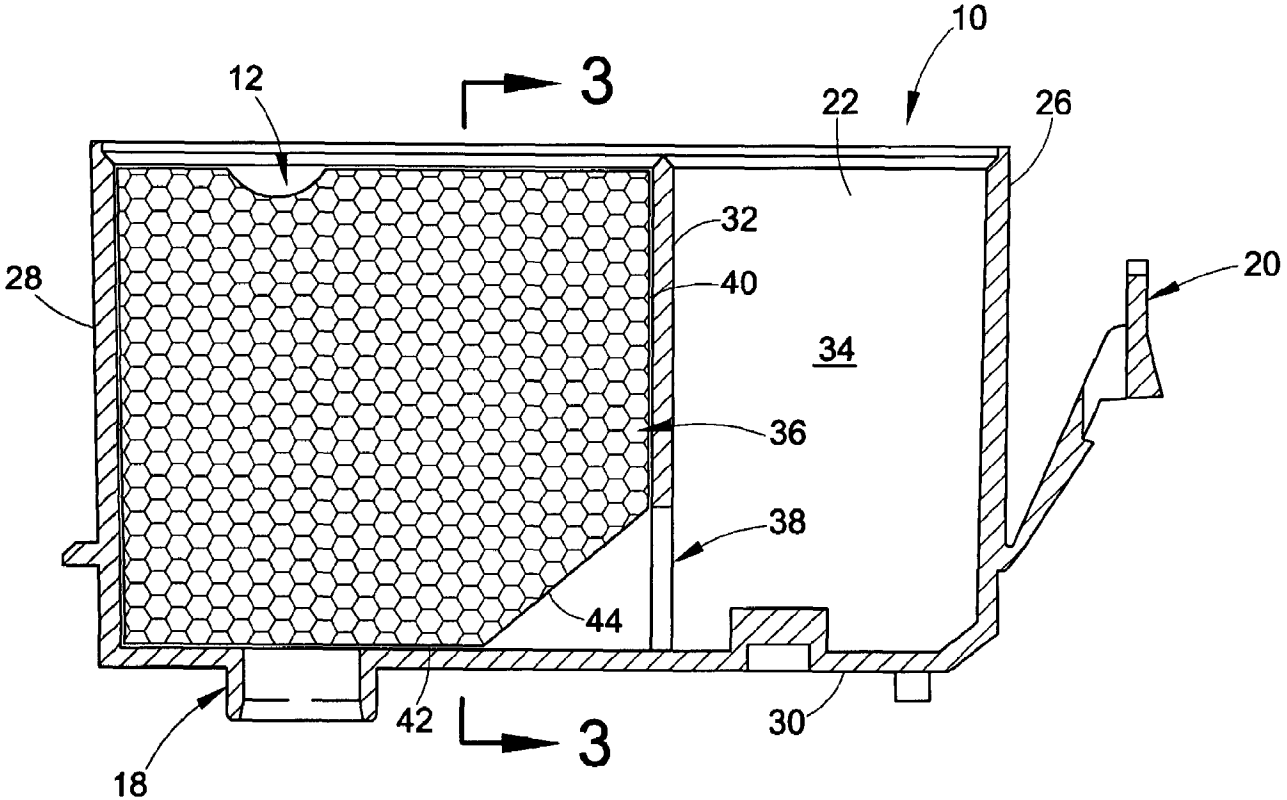
FIG. 2 is a sectional elevation view of the container shell and showing a block of ink absorbing material in one of the chambers thereof.
Figure 5:
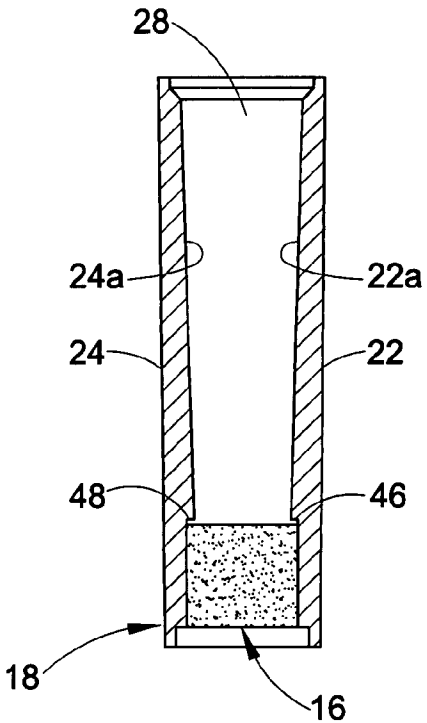
FIG. 5 is a cross-sectional elevation view of the shell looking in the direction of line 5-5 in FIG. 4.
Figure 4:
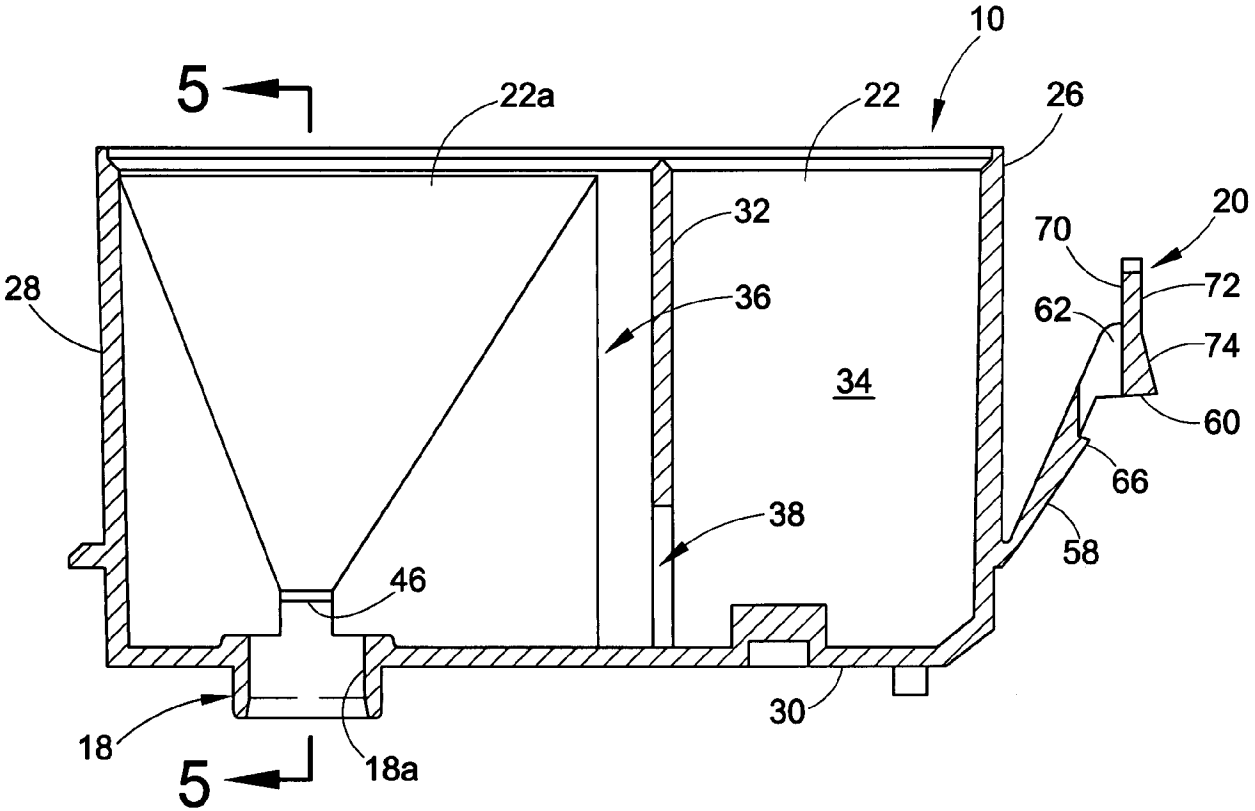
FIG. 4 is a sectional elevation view of the shell with the block of ink absorbing material removed and showing one embodiment of a wick retaining structure.
Figure 8:
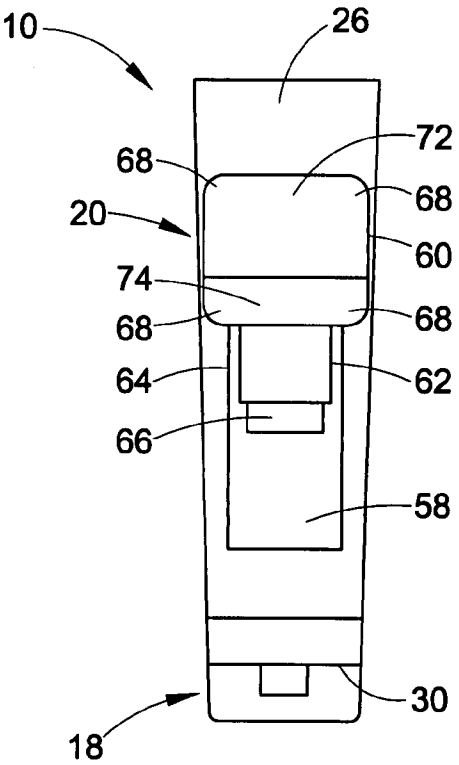

As seen in FIGS. 2 and 3 of the drawing, shell 10 comprises a pair of spaced apart side walls 22 and 24, a front wall 26, a rear wall 28, and a bottom wall 30. A partition 32 divides the interior of shell 10 into first and second chambers 34 and 36, respectively, and a window or opening 38 through the partition places the two chambers in fluid flow communication. As is well known, chamber 36 receives the block of ink absorbing material 12 and chamber 34 receives and stores ink which is transferred to ink absorbing material 12 through opening 38.

In accordance with one aspect of the invention, block 12 of ink absorbing material has planar front and bottom surfaces 40 and 42, respectively, and a planar surface 44 extending at an angle to and intersecting the planes of surfaces 40 and 42 respectively above bottom wall 30 and inwardly of chamber 36 from partition 32. It will be appreciated that block 12 extends between the inner surfaces of side walls 22 and 24 of shell 10, whereby surface 44 is of considerably greater area than that of opening 38 which, as seen in FIG. 3, has a width w and a height h. While height h is greater than width w, for the purpose set forth hereinafter, it will be appreciated that the angled surface 44 on block 12 can be associated with any window contour which will provide for the area of surface 44 to be greater than the area of opening 38. Preferably, surface 44 is at an angle of about 45° with respect to bottom wall 30 of the container shell but, again, it will be appreciated that other angular relationships will provide the increased area benefit with respect to surface 44 and which, as set forth hereinabove, allows for a higher level of ink saturation and a more constant transfer rate of ink from chamber 34 to chamber 36 and ink absorbing material 12. As will be further appreciated from FIG. 2, the increased area provided by surface 44 allows ink to saturate across the lower portion of block 12 more freely than with a block which would facially engage partition 40 and bottom wall 30 to the lower corner therebetween. It will be appreciated too that the benefits obtained through the provision of angled surface 44 facing opening 38 are independent of the specific area of surface 44 which, accordingly, can be less than the area in the embodiment shown herein.

In accordance with another aspect of the invention, and as seen in FIG. 3 and mentioned hereinabove, opening 38 through partition 32 has a height h which is greater than its width w. This geometry allows the transfer of ink from chamber 34 to chamber 36 at a higher point within the block of ink absorbing material and, further, enables the latter to maintain a consistently higher saturation level during printing. Moreover, the higher saturation level enables the ink absorbing material to deliver ink at a higher rate and to maintain a consistent back pressure. It will be appreciated that these attributes are independent of the specific dimensions of opening 38 and, in connection with the geometry of the opening, the height h is at least equal to and, preferably, is always greater than the width w. Accordingly, it will be appreciated that the size of the window is limited only by the physical limits of the ink container. In the embodiment illustrated, for an ink container shell having a height of about 39 mm between the outer surface of bottom wall 30 and the upper edges of the side, front and rear walls, and having a width of about 9 mm between the inner sides of side walls 22 and 24, opening 38 has a width w of three millimeters and a height h of 11 mm. Furthermore, it will be appreciated that the particular geometry of opening 38 is independent of the preferred angle cut providing surface 44 on the ink absorbing material. In this respect, the benefits of having the height of opening 38 equal to or greater than the width thereof are obtainable with a block of ink absorbing material wherein the front and bottom faces 40 and 42 thereof extend to and intersect at the corner between the inner side of bottom wall 30 and the side of partition 32 facing chamber 36.

In accordance with a further aspect of the invention, as shown in FIGS. 4, 5, 6, and 7 of the drawing, ink container shell 10 is provided with a wick retaining arrangement which enables introducing wick 16, which is circular, into outlet port 18 from beneath the ink container shell and limits displacement of the wick inwardly of chamber 36. In the embodiment illustrated in FIGS. 4 and 5 of the drawing, the wick retaining arrangement is provided by tapering the inner sides 22*a* and 24*a* of side walls 22 and 24 in chamber 36 to converge in the direction toward bottom wall 30 of the ink container shell, and offsetting the lower ends of the inner surfaces of the walls laterally outwardly to provide ledges 46 and 48 which overlie the inner end of wick 16 when the latter is introduced into the circular interior 18*a* of outlet port 18, thus limiting or stopping additional movement of the wick into the chamber and the block of ink absorbing material therein which is not shown in FIGS. 4 and 5.

Figure 7:
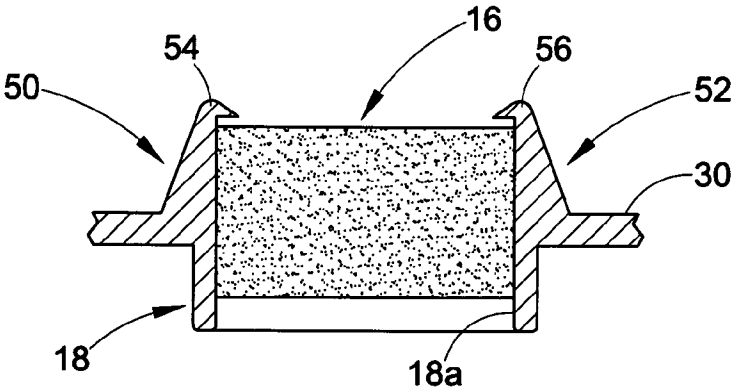
FIG. 7 is an enlarged cross-sectional elevation view taken along line 7-7 in FIG. 6; and, FIG. 8 is a front elevation view of the container shell, lever and lever tongue looking in the direction from right to left in FIG. 1.
Figure 6:
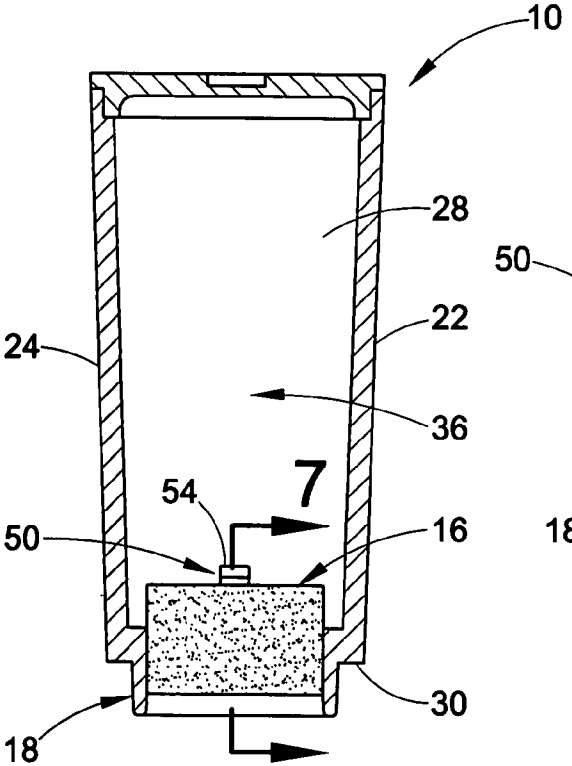
FIG. 6 is a cross-sectional elevation view of an ink container shell showing another embodiment of a wick retaining structure.

In the embodiment shown in FIGS. 6 and 7 of the drawing, the wick retaining arrangement is provided by a pair of fingers 50 and 52 extending upwardly from bottom wall 30 of the ink container shell on diametrically opposite sides of the interior 18*a* of outlet port 18 and which fingers have upper ends 54 and 56, respectively, extending radially inwardly of the interior of the outlet port to overlie the inner end of wick 16 when the latter is introduced into the outlet port, thus to limit or stop inward displacement of the wick into chamber 36 and the block of wicking material therein, not shown in FIGS. 6 and 7.

In accordance with yet another aspect of the invention, as best seen in FIGS. 1, 2, 4, and 8 of the drawing, lever and tongue component 20 is profiled to facilitate the ease of inserting and removing an ink container from a holder therefore while minimizing the existence of rough edges and corners which can affect the comfort level of a person manipulating the ink container into or out of engagement with the holder. In this respect, the lever and tongue component 20 comprises a lever portion 58 hingedly attached at its lower end to front wall 26 of the ink container shell and a tongue element 60 attached to the upper end of the lever portion by a pair of laterally spaced apart fingers 62 and 64. As is well known, the lever and tongue component is provided with a forwardly extending projection 66 adapted to matingly interengage with a component on the ink container holder to releasably interengage the container and holder. Tongue 60 has linear top, bottom and side edges, not designated numerically, and rounded corners 68 therebetween. Further, the tongue has a planar inner side 70 facing and parallel to front wall 26 of the shell and an outer side defined by a planar upper portion 72 generally parallel to inner side 70 and an arcuate lower portion 74 which curves gently outwardly from the plane of upper portion 72. Accordingly, it will be appreciated that all of the surfaces of the tongue engaged by a user's finger or fingers are smooth.

While considerable emphasis has been placed herein on preferred embodiments of the invention, it will be appreciated that other embodiments can be devised and that many changes can be made in the preferred embodiments without departing from the principals of the invention. Accordingly, it is to be distinctly understood that the foregoing descriptive matter is to be interpreted merely as illustrative of the invention and not as a limitation and that it is intended to include other embodiments and all modifications of the preferred embodiments insofar as they come within the scope of the appended claims or the equivalents thereof.

Having described the invention, it is so claimed:

1. In an ink container shell for an ink jet cartridge comprising spaced apart side walls, a front wall, a rear wall, and a bottom wall, a partition in said shell dividing the interior thereof into first and second chambers for respectively receiving an ink and an ink absorbing material, an opening through a bottom portion of said partition adjacent said bottom wall for communicating ink in said first chamber with ink absorbing material in said second chamber, and an outlet port in said bottom wall for said second chamber the improvement comprising: said opening having an area, and ink absorbing material in said second chamber having a surface at a lower end portion thereof facing said opening and having an area greater than the area of said opening, said enlarged surface area configured to allow ink to freely saturate across said lower end portion of said ink absorbing material and provide a substantially constant transfer rate of ink in said first chamber into said ink absorbing material, wherein said bottom wall is in its entirety a substantially straight wall portion and wherein said opening has a bottom portion which lies in substantially the same plane as a top portion of said outlet port.

2. The improvement according to claim 1, wherein said ink absorbing material has first and second sides in planes at right angles to one another, said surface angularly extending between and intersecting said planes.

3. The improvement according to claim 2, wherein said surface is planar.

4. The improvement according to claim 3, wherein said planar surface is at an angle of 45° to said first and second sides.

5. The improvement according to claim 4, wherein said opening is rectangular and said surface is planar.

6. The improvement according to claim 1, wherein said opening has a height above said bottom wall and said surface has an upper end spaced above said bottom wall and a lower end adjacent said bottom wall and spaced inwardly of said second chamber from said partition.

7. The improvement according to claim 1, wherein said opening has a width and a height, wherein said height is greater than said width.

8. The improvement according to claim 7, wherein said height is more than three times said width.

9. In an ink container shell for an ink jet cartridge comprising spaced apart side walls, a front wall, a rear wall, and a bottom wall, a partition in said shell dividing the interior thereof into first and second chambers for respectively receiving an ink and an ink absorbing material, an opening through said partition for communicating ink in said first chamber with ink absorbing material in said second chamber, and an outlet port in said bottom wall for said second chamber, the improvement comprising: said outlet port having inner and outer ends with respect to said second chamber, and means formed on said container located in said second chamber for limiting inward displacement of wicking material received in said outlet port into said second chamber, wherein said means in said second chamber includes fingers extending radially inwardly of said outlet port.

10. The improvement according to claim 9, wherein said outlet port is circular and said fingers include diametrically opposed first and second fingers.

11. The improvement according to claim 9, wherein said means in said second chamber includes ledges on said side walls extending radially inwardly of said outlet port.

12. The improvement according to claim 11, wherein said side walls include upper portions which taper inwardly of said second chamber in the direction toward said bottom wall and lower portions which are offset laterally outwardly from said upper portions and interconnected therewith by portions providing said ledges.

* * * * *